US009923326B2

(12) United States Patent
Hung

(10) Patent No.: US 9,923,326 B2
(45) Date of Patent: Mar. 20, 2018

(54) LOCK MECHANISM AND HAND TOOL HAVING THE SAME

(71) Applicant: Robert W Sullivan, Simi Valley, CA (US)

(72) Inventor: Wen-Lung Hung, New Taipei (TW)

(73) Assignee: Sullstar Technologies, Inc., Simi Valley, CA (US)

( * ) Notice: Subject to any disclaimer, the term of this patent is extended or adjusted under 35 U.S.C. 154(b) by 0 days.

(21) Appl. No.: 14/998,886

(22) Filed: Feb. 29, 2016

(65) Prior Publication Data

US 2017/0104303 A1 Apr. 13, 2017

(30) Foreign Application Priority Data

Oct. 13, 2015 (TW) ..... 104133573 A

(51) Int. Cl.
*H01R 43/042* (2006.01)
*B25B 27/14* (2006.01)
*B25B 7/14* (2006.01)

(52) U.S. Cl.
CPC ..... *H01R 43/042* (2013.01); *B25B 7/14* (2013.01); *B25B 27/14* (2013.01); *B25B 27/146* (2013.01)

(58) Field of Classification Search
CPC ..... H01R 43/042; B25B 7/14; B25B 27/14; B25B 27/146
USPC ..... 72/409.12
See application file for complete search history.

(56) References Cited

U.S. PATENT DOCUMENTS 2,861,489 A * 11/1958 Barnes ..... H01R 43/042 72/409.1
3,379,046 A * 4/1968 Glenn ..... H05K 13/0007 140/106
4,589,271 A * 5/1986 Laux ..... B25B 7/12 29/751
4,742,737 A * 5/1988 Hatfield ..... B23D 29/023 81/355
5,150,488 A 9/1992 Yuan
5,842,371 A * 12/1998 Liaw ..... H01R 43/042 29/751
6,112,404 A * 9/2000 Tarpill ..... B25B 27/10 29/268
2003/0131647 A1 7/2003 Chin
2015/0165597 A1 6/2015 Chern
2015/0273664 A1 10/2015 Skodje

FOREIGN PATENT DOCUMENTS

EP 2737791 A1 6/2014
TW 1363676 5/2012

* cited by examiner

*Primary Examiner* — David B Jones
(74) *Attorney, Agent, or Firm* — Gene W. Arant; Charles C.H. Wu & Assocs., APC; Christopher Balzan

(57) ABSTRACT

The present invention relates to a lock mechanism for a hand tool having two handles, which comprises: a latch and a retainer for retaining the latch. The latch comprises: a disc and a shaft passing through and fixed with the disc. The shaft is coaxial with the disc. The lock mechanism is disposed within the hand tool.

20 Claims, 4 Drawing Sheets

LOCK MECHANISM AND HAND TOOL HAVING THE SAME

CROSS-REFERENCE TO RELATED APPLICATIONS

The present invention claims the benefit of priority of Taiwan application No.104133573 of Oct. 13, 2015, entitled "Lock Mechanism and Pliers Having the Same," the contents of which are herein incorporated by reference.

BACKGROUND

Field of the Invention

The present invention relates to a lock mechanism for a hand tool, in particular to pliers or crimp tools having two handles.

Description of Related Art

Pliers and crimp tools are frequently used for machining articles. A crimp tool can bend, shear, strip and crimp insulated wiring and connectors thereof. These connectors include the RJ-45 connector, a connector standardized as the 8P8C modular connector, and the RJ-11 connector, a connector for telephone connections etc. A crimp tool usually includes two handles to be grasped by a user during operation. Generally speaking, when the crimp tool is in a contracted position, the two handles abut against or are adjacent to each other, and when the crimp tool is in an expanded position, the two handles are separate from each other. As a labor saving device, some crimp tools include a biasing mechanism such as a spring for biasing one handle against the other so that the handles tend to be urged into an expanded position. Users thus only need to move the handles from the expanded position to the contracted position when using the crimp tool, while the biasing mechanism will return the handles back to the expanded position.

A crimp tool or a plier occupies smallest space when the handles are contracted and close to each other. Therefore, when the crimp tool or the plier is not in use and is to be stored, the handles thereof should first be contracted and fixed. To prevent the handles from leaving the contracted position, a plier as described in Taiwan Pat. No. I363676 is provided with a snap ring at the end of one handle to be engaged with a knob at the end of the other handle so that the two handles can be fixed after they are contracted for storage. However, the snap ring and the knob are disposed externally to the plier, and not only occupy additional space but may also cause injury.

Given the above, there is need for a lock mechanism for hand tools such as pliers or crimp tools having two handles that does not occupy additional space and is safe for users.

BRIEF SUMMARY OF THE INVENTION

In one embodiment of the invention, a lock mechanism for a hand tool is provided, which comprises: a latch and a retainer for retaining the latch. The latch comprises: a disc and a shaft passing through the disc; the middle of the shaft is fixed with the center of the disc. The shaft is coaxial with the disc and they rotate together with stability.

In another embodiment of the invention, a hand tool is provided, which comprises: a first handle, a second handle, and a lock mechanism. The second handle has an end portion pivotally connected with an end portion of the first handle, wherein the second handle pivots between a first position where the second handle is away from the first handle and a second position where the second handle is adjacent to the first handle. The lock mechanism comprises: a latch and a retainer. The latch comprises: a disc and a shaft passing through and fixed with the disc. The shaft is coaxial with the disc. The latch is pivotally disposed at the end portion of the first handle along a transverse direction and is switchable between a third position and a fourth position. The retainer is disposed at the end portion of the first handle for retaining the latch at the third position or the fourth position. When the latch is at the third position, the shaft of the latch detains the second handle at the first position and when the latch is at the fourth position, the disc of the latch detains the second handle at the second position.

DETAILED DESCRIPTION OF THE EXEMPLARY EMBODIMENTS

Figure 1A:
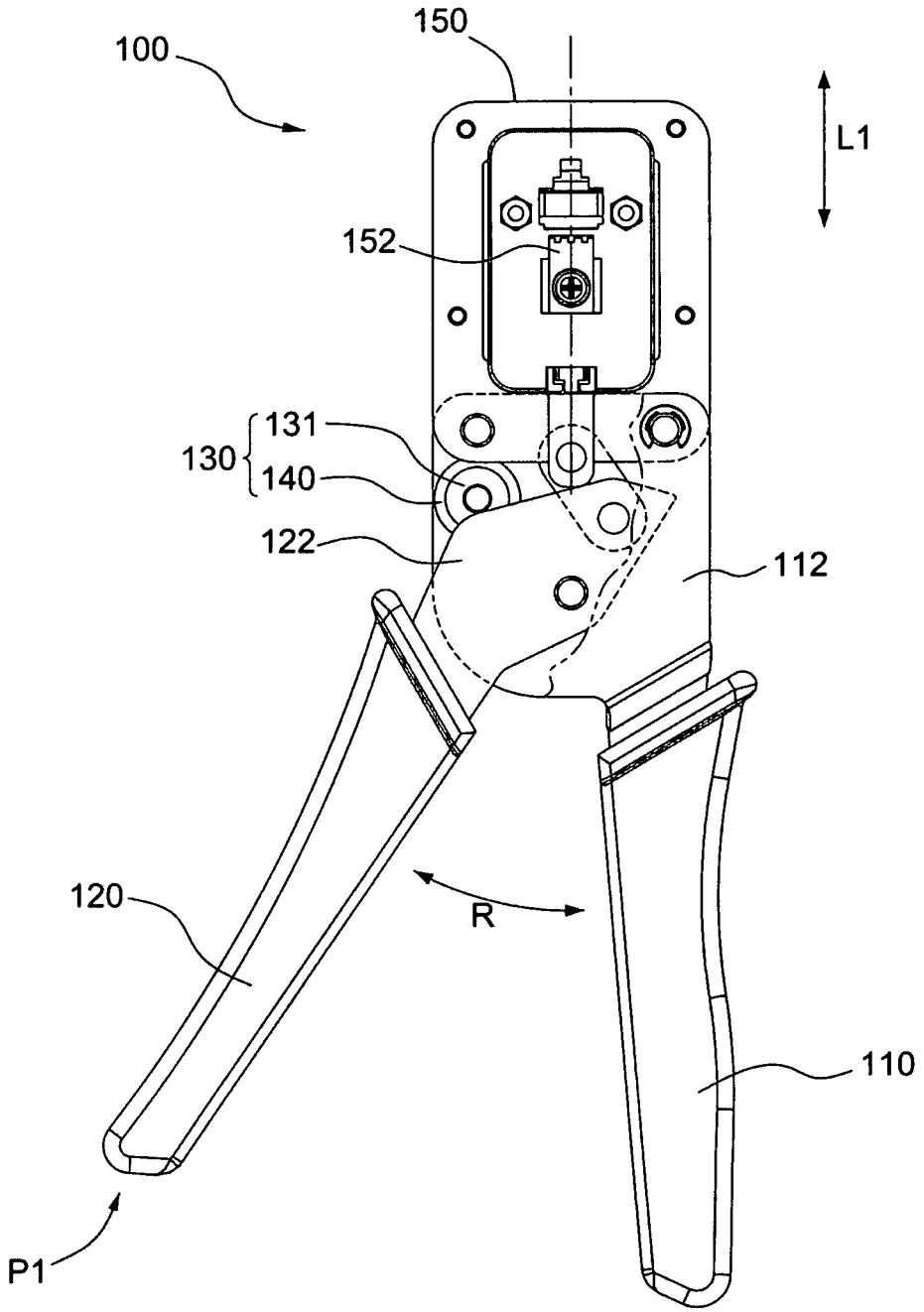
FIG. 1A is a schematic view showing the handles of the crimp tool of one embodiment of the present invention in an expanded position.

The characteristics, subject matter, advantages, and effects of the present invention are detailed hereinafter by reference to the embodiments of the present invention and the accompanying drawings. It is understood that the drawings referred to in the following description are intended only for purposes of illustration and do not necessarily show the actual proportion and precise arrangement of the embodiments. Therefore, the proportion and arrangement shown in the drawings should not be construed as limiting or restricting the scope of the present invention.

Figure 1B:
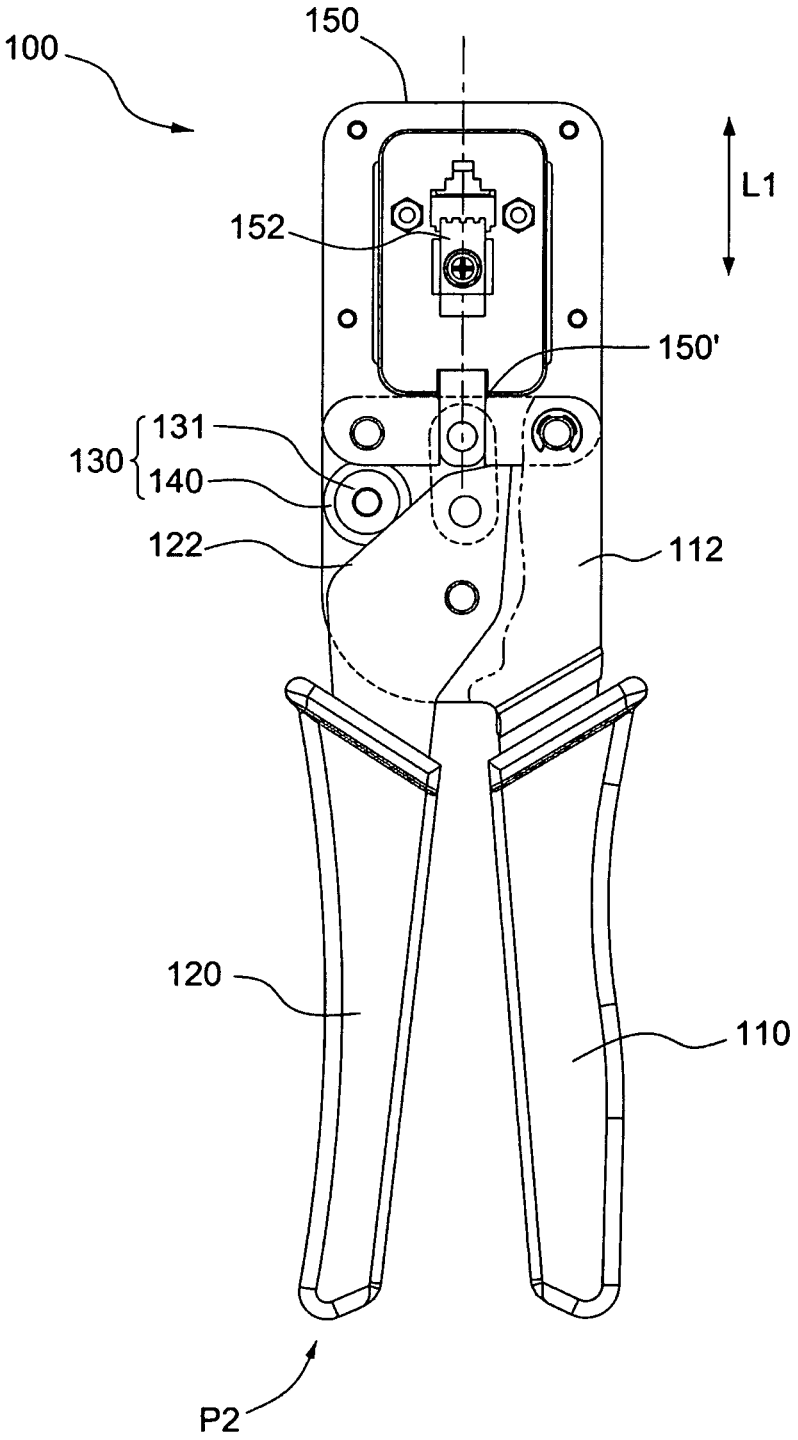
FIG. 1B is a schematic view showing the handles of the crimp tool of FIG. 1A in a contracted position.
Figure 2A:
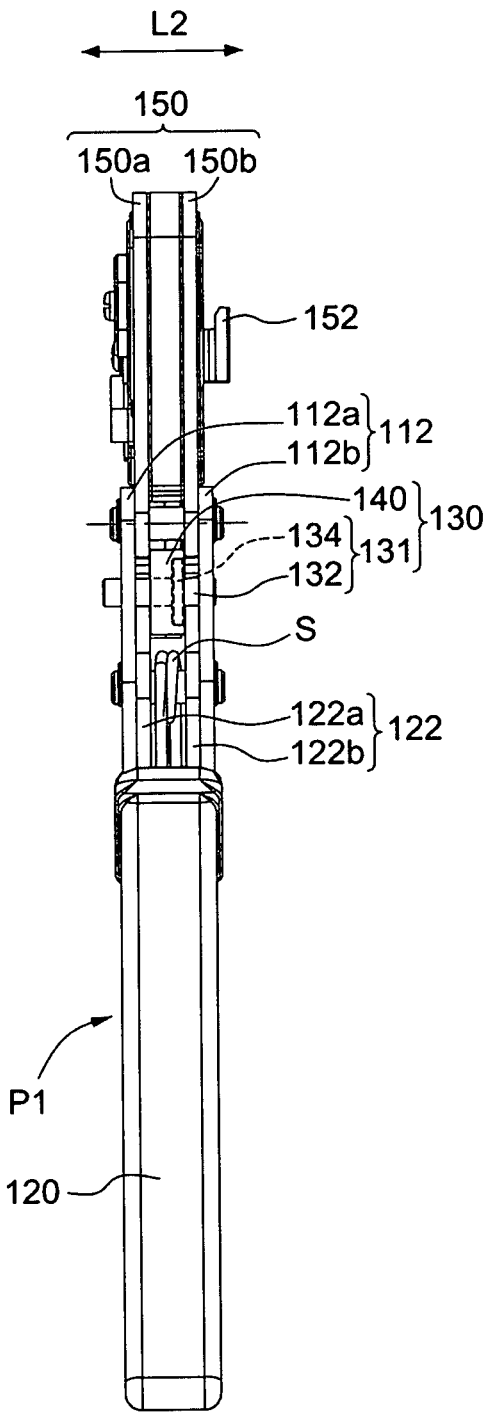
FIG. 2A is a schematic structural view of the left side of the crimp tool of FIG. 1A.
Figure 2B:
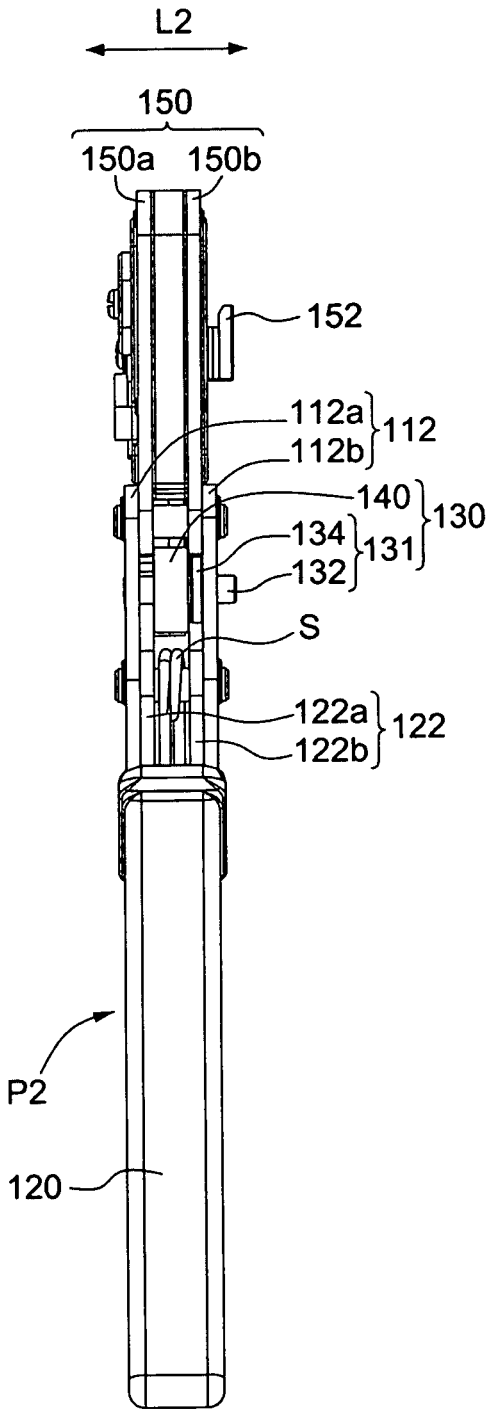
FIG. 2B is a schematic structural view of the left side of the crimp tool of FIG. 1B.

Please refer to FIGS. 1A and 1B. FIG. 1A shows the handles 110, 120 of the crimp tool 100 of one embodiment of the present invention in an expanded position and FIG. 1B shows the handles 110, 120 of the crimp tool 100 of the embodiment in a contracted position. As shown in FIGS. 1A and 1B, the crimp tool 100 comprises: a first handle 110, a second handle 120, and a lock mechanism 130. The second handle 120 has an end portion 122 pivotally connected with an end portion 112 of the first handle 120, wherein the second handle 120 pivots along a rotational path (R) between a first position (P1) where the second handle 120 is away from the first handle 110 (as shown in FIG. 1A) and a second position (P2) where the second handle 120 is adjacent to the first handle 110 (as shown in FIG. 1B). As shown in FIGS. 2A and 2B, a biasing element, which is a spring (S), is provided at the pivot of the end portion 112 of the first handle 110 and the end portion 122 of the second handle 120. When the two handles are moved toward each other (e.g., grasped by a hand of a user), the spring (S) biases the second handle 120 so that the second handle 120 tends to move toward the first position (P1) along the rotational path (R). The head 150 of the crimp tool 100 has a crimping element 152 for crimping a connector of insulated wiring.

When the second handle 120 is pressed to move from the first position P1 along the path (R) to the second position (P2), the crimping element 152 is indirectly actuated by the second handle 120 to move upward along a vertical direction (L1) to a crimping position as shown in FIG. 1B to crimp a connector.

As shown in FIG. 2A and FIG. 2B, the end portion 112 of the first handle 110 comprises a first plate 112*a* and a second plate 112*b* opposite the first plate 112*a*. The end portion 122 of the second handle 120 comprises a third plate 122*a* and a fourth plate 122*b* opposite the third plate 122*a*, wherein the third plate 122*a* and the fourth plate 122*b* of the end portion 122 of the second handle 120 are sandwiched between and pivotally connected with the first plate 112*a* and the second plate 112*b* of the end portion 112 of the first handle 110. The head 150 comprises a fifth plate 150*a* and a sixth plate 150*b* opposite the fifth plate 150*a*. The fifth plate 150*a* and the sixth plate 150*b* of the head 150 are sandwiched between and fixed to the first plate 112*a* and the second plate 112*b* of the end portion of the first handle 110. As shown in FIGS. 2A and 2B, the fifth plate 150*a* and the sixth plate 150*b* of the head 150 are generally aligned with the third plate 122*a* and the fourth plate 122*b* of the end portion 122 of the second handle 120 respectively in a direction (L2) transverse to the vertical direction (L1). As such, when the second handle 120 is pressed to move along the rotational path (R) toward the first handle 110 to the second position (P2), the configurations of the third plate 122*a* and the fourth plate 122*b* of the end portion 122 of the second handle 120 cause the upper peripheral surfaces of the third plate 122*a* and the fourth plate 122*b* to abut against the lower peripheral surfaces of the fifth plate 150*a* and the sixth plate 150*b* of the head 150 so that the second handle 120 is detained from moving further toward and abut the first handle 110.

Figure 3A:
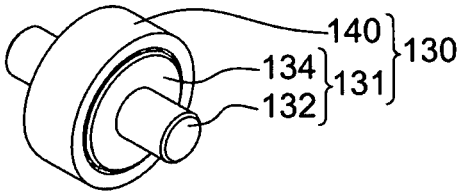
FIG. 3A is a schematic view showing the lock mechanism in the embodiment of FIG. 1A wherein the latch and the retainer are assembled.
Figure 3B:
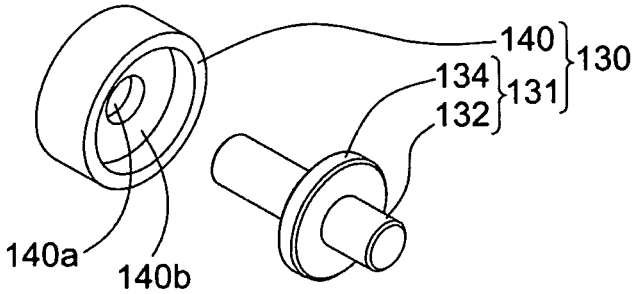
FIG. 3B is a schematic view showing the lock mechanism in the embodiment of FIG. 1A wherein the latch is detached from the retainer.

FIG. 3A shows a perspective view of the lock mechanism 130 in one embodiment of the present invention. FIG. 3B shows an exploded view of the lock mechanism 130. As shown in FIGS. 3A and 3B, the lock mechanism 130 comprises: a latch 131 and a retainer 140. The latch 131 comprises: a disc 134 and a shaft 132 passing through the disc 134 and the area around the middle of the shaft 132 is fixed with the center of the disc 134. The shaft 132 is coaxial with the disc 134. Preferably, the shaft 132 is integrally formed with the disc 134. The retainer 140 is a sleeve having a through hole 140*a* and a recess 140*b* formed therein. The latch 131 is movably inserted into the recess 140*b*, and the recess 140*b* communicates with the through hole 140*a*. The sleeve is made of elastic material, preferably polyurethane. The diameter of the shaft 132 is smaller than that of the disc 134.

As shown in FIGS. 2A and 2B, the latch 131 is pivotally provided at the end portion 112 of the first handle 110 along the transverse direction (L2). Specifically, the shaft 132 of the latch 131 is pivotally supported at the first plate 112*a* and the second plate 112*b* of the end portion 112 of the first handle 110 with its two ends respectively. The latch 131 is axially moveable along the transverse direction (L2) and accordingly is switchable between a third position (as shown in FIG. 2A) and a fourth position (as shown in FIG. 2B) so as to detain the second handle 120 in a first position (P1) or a second position (P2). When the latch 131 is at the third position as shown in FIG. 2A, the disc 134 is within the recess 140*b* and one end of the shaft 132 protrudes from a side surface of the first plate 112*a* of the first handle 110. When the latch 131 is at the fourth position as shown in FIG. 2B, the disc 134 at least partially protrudes from the recess 140*b* along the transverse direction (L2) and the other end of the shaft 132 protrudes from a side surface of the second plate 112*b* of the first handle 110.

When the latch 131 is at the third position, the second handle 120 is pivotable along the rotational path (R) between the first position (P1) and the second position (P2). In this situation, as shown in FIGS. 1A and 2A, if there is no external force applied to the second handle 120, the spring (S) biases the second handle 120 so that it moves away from the first handle 110 and the shaft 132 of the latch 131 detains the second handle 120 at the first position (P1). As illustrated in FIGS. 1B and 2B, when the second handle 120 is pressed so that it moves toward the first handle 110 to the second position (P2), the latch 131 is moved from the third position along the transverse direction (L2) to the fourth position and the disc 134 of the latch 131 detains the second handle 120 at the second position (P2). In this situation, the second handle 120 is fixed at the second position (P2) and the crimp tool 100 occupies the smallest space, which is convenient for storage. In view of the above, by switching the latch 131 between the third position and the fourth position thereof, a user can detain the second handle 120 at the first position (P1) or at the second position (P2).

The retainer 140 of this embodiment is disposed to not be located in the rotational path (R) of the second handle 120 between the first position (P1) and the second position (P2). In one embodiment of the invention, the retainer 140 is a sleeve made of elastic material, preferably polyurethane. At least a part of the sleeve is sandwiched between the third plate 122*a* and the fourth plate 122*b* of the end portion 122 of the second handle 120. The length of the sleeve along the transverse direction (L2) is approximately the same as the distance between the third plate 122*a* and the fourth plate 122*b* of the end portion 122 of the second handle 120. In another embodiment of the present invention, at least a part of the sleeve is sandwiched between the fifth plate 150*a* and the sixth plate 150*b* of the head 150. In that case, the length of the sleeve along the transverse direction (L2) is approximately the same as the distance between the fifth plate 150*a* and the sixth plate 150*b* of the head 150. In an alternative embodiment, one part of the sleeve is sandwiched between the third plate 122*a* and the fourth plate 122*b* of the end portion 122 of the second handle 120 and the other part of the sleeve is sandwiched between the fifth plate 150*a* and the sixth plate 150*b* of the head 150.

In one embodiment of the invention, the retainer 140 is a sleeve having a through hole 140*a* and a recess 140*b* formed therein. The latch 131 is movably inserted into the recess 140*b*, which communicates with the through hole 140*a*. The shaft 132 passes through the through hole 140*a* of the sleeve 140 with one end thereof. Two ends of the shaft 132 are pivotally supported at the end portion 112 of the first handle 110. When the latch 131 is disposed at the third position, the latch 131 is received within the recess 140*b* and the exposed side surface of the disc 134 of the latch 131 is generally flush with a side surface of the sleeve 140. When the latch 131 is pressed to move along the transverse direction (L2) from the third position to the fourth position, the disc 134 is moved from the recess 140*b* to at least partially protrude therefrom.

As such, when the latch 134 is received in the recess 140*b* (i.e., in the third position), the shaft 132 is in the rotational path (R) of the second handle 120. Where the handles 110, 120 of the crimp tool 100 are not grasped, the second handle 120 is biased by the spring (S) to move away from the first handle 110 and the configurations of at least one of the third plate 122*a* or the fourth plate 122*b* of the end portion 122 of the second handle 120 cause the at least one of the upper peripheral surfaces of the third plate 122*a* or the fourth plate

122*b* to abut against the shaft 132 to detain the second handle 120 at the first position (P1). In the embodiment shown in the drawings, both the upper peripheral surfaces of the third plate 122*a* and the fourth plate 122*b* abut against the side of the shaft 132.

As shown in FIG. 2A, when the upper peripheral surfaces of the third plate 122*a* and the fourth plate 122*b* abut against the shaft 132 (i.e., the second handle is at the first position (P1)), since the diameter of the disc 134 is larger than that of the shaft 132 abutted by the fourth plate 122*b*, the upper portion of the fourth plate 122*b* is located beside and overlaps the disc 134 in the transverse direction (L2) so as to prevent the latch 134 from moving from the third position toward the fourth position along the transverse direction (L2). In this situation, the second handle 120 is free to pivot between the first position (P1) and the second position (P2) along the rotational path (R) and the crimp tool 100 is not locked. In an alternative embodiment, it can be the upper peripheral surfaces of only one of the third plate 122*a* and the fourth plate 122*b* that abuts against the shaft 132 and it is the third plate 122*a* that prevents the latch 134 from moving outward.

When the second handle 120 is pressed so that it gradually moves from the first position (P1) toward the second position (P2), the overlapping area between the upper portion of the fourth plate 122*b* and the disc 134 of the latch 131 gradually decreases. When the second handle 120 reaches the second position (P2), as shown in FIGS. 1B and 2B, the upper portion of the fourth plate 122*b* does not overlap the disc 134 of the latch 131 in the transverse direction (L2) and a user can press against the shaft 132 of the latch 131 so that the latch 131 moves from the third position (as shown in FIG. 2A) to the fourth position (as shown in FIG. 2B). As such, the disc 134 is moved along the transverse direction (L2) from the recess 140*b* to at least partially protrude from the recess 140*b* and in the rotational path (R) of the second handle 120. When the user releases the pressure grasped on the second handle 120, the peripheral surface of the fourth plate 122*b* is urged by the spring (S) to abut against the peripheral surface of the disc 134 so that the second handle 120 is detained (locked) at the second position (P2) and cannot be moved away from the first handle 110.

When the second handle 120 is at the second position (P2) and locked by the latch 131, the crimp tool occupies the smallest space. This is called storage mode. Also, when second handle 120 is at the second position (P2), the fourth plate 122*b* is not in the path of the latch 131 between the third position and the fourth position. The latch 131 thus is switchable between the third position and the fourth position. If a user would like to switch the crimp tool 100 from storage mode to working mode, he/she can simply move the latch 131 from the fourth position to third position by pressing the shaft 132 of the latch that protrudes from the side surface of the second plate 112*b* of the first handle as shown in FIG. 2B so that the disc 134 retreats back to the recess 140*b* of the sleeve 140. After the retreat, the second handle 120 is movable along the rotational path (R) toward the first handle 110 and is freely pivotable between the first position (P1) and the second position (P2).

In an alternative embodiment of the invention in which the opening of the recess 140*b* is arranged to face the first plate 112*a* of the first handle 110 (in the embodiment of the drawings, the recess 140*b* faces the second plate 112*b*), it will be the third plate 122*a* that controls whether the latch 131 is switchable between two positions along the transverse direction (L2).

The lock mechanism 130 in one embodiment of the invention is simple in structure but useful, and basically contains two elements: the latch 131 having the disc 134 and the shaft 132 and the retainer 140. Furthermore, the lock mechanism 130 is generally disposed within the crimp tool 110. Thus, it does not occupy additional space and will not injure a user. In addition to a crimp tool, the lock mechanism 130 can be used on any suitable hand tools that have two handles, such as pliers or the like.

The foregoing embodiments are illustrative of the technical concepts and characteristics of the present invention so as to enable a person skilled in the art to gain insight into the contents disclosed herein and to implement the present invention accordingly. However, it is understood that the embodiments are not intended to restrict the scope of the present invention. Hence, all equivalent modifications to and variations of the disclosed embodiments made without departing from the spirit and principle of the present invention should fall within the scope of the appended claims.

What is claimed is:

1. A lock mechanism for a hand tool, comprising:
a latch, comprising:
a disc; and
a shaft passing through and fixed with the disc, the shaft being coaxial with the disc; and
a retainer for retaining the latch,
wherein the retainer is a sleeve having a through hole and a recess formed therein, the latch is movably inserted into the recess, and the recess communicates with the through hole.

2. The lock mechanism according to claim 1, wherein the shaft is integrally formed with the disc.

3. The lock mechanism according to claim 2, wherein the sleeve is made of elastic material.

4. The lock mechanism according to claim 3, wherein the elastic material is polyurethane.

5. The lock mechanism according to claim 1, wherein the sleeve is made of elastic material.

6. A hand tool, comprising:
a first handle;
a second handle having an end portion pivotally connected with an end portion of the first handle, wherein the second handle pivots between a first position where the second handle is away from the first handle and a second position where the second handle is adjacent to the first handle;
a lock mechanism, comprising:
a latch, comprising:
a disc; and
a shaft passing through and fixed with the disc, the shaft being coaxial with the disc,
wherein the latch is pivotally disposed at the end portion of the first handle along a transverse direction and is switchable between a third position and a fourth position; and
a retainer, disposed at the end portion of the first handle for retaining the latch at the third position or the fourth position,
wherein when the latch is at the third position, the shaft detains the second handle at the first position and when the latch is at the fourth position, the disc detains the second handle at the second position.

7. The hand tool according to claim 6, wherein the shaft is integrally formed with the disc.

8. The hand tool according to claim 7, wherein the retainer is not in the path of the second handle between the first position and the second position.

9. The hand tool according to claim 7, wherein the retainer is a sleeve having a through hole and a recess formed therein, the latch is movably inserted into the recess, and the recess communicates with the through hole.

10. The hand tool according to claim 9, wherein the sleeve is made of elastic material.

11. The hand tool according to claim 9, wherein the elastic material is polyurethane.

12. The hand tool according to claim 9, wherein when the latch is at the third position, the disc is within the recess and when the latch is at the fourth position, the disc at least partially protrudes from the recess along the transverse direction.

13. The hand tool according to claim 9, wherein the end portion of the first handle comprises a first plate and a second plate opposite the first plate, the end portion of the second handle comprises a third plate and a fourth plate opposite the third plate, wherein the third plate and the fourth plate of the end portion of the second handle are sandwiched between the first plate and the second plate of the end portion of the first handle, and a part of the sleeve is sandwiched between the third plate and the fourth plate of the end portion of the second handle.

14. The hand tool according to claim 13, wherein the length of the sleeve along the transverse direction is approximately the same as the distance between the third plate and the fourth plate of the end portion of the second handle.

15. The hand tool according to claim 13, further comprising a head for machining a connector, the head comprising a fifth plate and a sixth plate opposite the fifth plate, the fifth plate and the sixth plate of the head are sandwiched between the first plate and the second plate of the end portion of the first handle and a part of the sleeve is sandwiched between the fifth plate and the sixth plate of the head.

16. The hand tool according to claim 15, wherein the length of the sleeve along the transverse direction is approximately the same as the distance between the fifth plate and the sixth plate of the head.

17. The hand tool according to claim 13, wherein when the latch is at the third position, the shaft detain one of the third plate and the fourth plate of the second handle at the first position and when the latch is at the fourth position, the disc detains the one of the third plate and the fourth plate of the second handle at the second position.

18. The hand tool according to claim 17, wherein when the second handle is at the first position, the one of the third plate and the fourth plate of the second handle is positioned to prevent the latch from moving from the third position toward the fourth position.

19. The hand tool according to claim 17, wherein when the second handle is at the second position, the one of the third plate and the fourth plate of the second handle is not in the moving path of the latch between the third position and the fourth position.

20. The hand tool according to claim 6, wherein an elastic element is disposed at the pivot of the end portion of the first handle and the end portion of the second handle for biasing the second handle toward the first position.

* * * * *